US010711596B2

(12) United States Patent
Orban

(10) Patent No.: US 10,711,596 B2
(45) Date of Patent: Jul. 14, 2020

(54) DOWNHOLE INSTRUMENT FOR DEEP FORMATION IMAGING DEPLOYED WITHIN A DRILL STRING

(71) Applicant: Schlumberger Technology Corporation, Sugar Land, TX (US)

(72) Inventor: Jacques Orban, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 643 days.

(21) Appl. No.: 15/097,724

(22) Filed: Apr. 13, 2016

(65) Prior Publication Data

US 2016/0298449 A1 Oct. 13, 2016

Related U.S. Application Data

(60) Provisional application No. 62/146,731, filed on Apr. 13, 2015, provisional application No. 62/147,246, filed on Apr. 14, 2015.

(51) Int. Cl.
*E21B 47/12* (2012.01)
*E21B 33/072* (2006.01)

(52) U.S. Cl.
CPC ..... *E21B 47/12* (2013.01); *E21B 33/072* (2013.01)

(58) Field of Classification Search
CPC ..... E21B 47/02208; E21B 47/02224; E21B 47/0905; E21B 47/091; E21B 47/12; E21B 47/121; E21B 47/122; E21B 47/14; E21B 47/16; E21B 47/18
See application file for complete search history.

(56) References Cited

U.S. PATENT DOCUMENTS 2,557,168 A * 6/1951 Arps ..... E21B 47/121 324/356
2,677,427 A 5/1954 Mckinney
2,906,342 A 9/1959 Russell
2,963,092 A 12/1960 Anderson
3,167,707 A 1/1965 Oliver
3,363,880 A 1/1968 Blagg
4,003,435 A 1/1977 Cullen et al.
4,090,573 A 5/1978 Rankin
(Continued)

FOREIGN PATENT DOCUMENTS

CA 2891162 A1 * 5/2014 ..... E21B 47/16
CA 2914552 A1 * 12/2014 ..... E21B 47/02208
(Continued)

*Primary Examiner* — Jennifer H Gay
(74) *Attorney, Agent, or Firm* — Rachel E. Greene

(57) ABSTRACT

Methods and systems for acquiring data in a wellbore. The method includes deploying an instrument connected to an instrument line into a drill string, through a sealed entry port formed in a drilling device coupled to the drill string, the drill string being at least partially within the wellbore, the wellbore penetrating a subterranean formation. The method also includes transmitting a signal from a source and through the formation. The signal is sensed by the instrument in the drill string. The method further includes determining one or more formation characteristics based on the signal sensed by the instrument, and performing one or more drilling processes using the drill string, while transmitting the signal, determining the one or more formation characteristics, or both.

3 Claims, 4 Drawing Sheets

(56) References Cited

U.S. PATENT DOCUMENTS 4,126,848 A 11/1978 Denison
4,143,721 A 3/1979 Zuvela et al.
4,153,120 A 5/1979 Zuvela et al.
4,325,438 A 4/1982 Zuvela
4,331,203 A 5/1982 Kiefer
4,578,675 A * 3/1986 MacLeod ..... E21B 17/003 166/66
4,689,775 A 8/1987 Scherbatskoy
4,739,325 A * 4/1988 MacLeod ..... E21B 17/003 324/342
4,857,831 A 8/1989 Davies et al.
4,965,774 A * 10/1990 Ng ..... E21B 47/00 367/25
5,095,993 A 3/1992 Huber et al.
5,107,705 A 4/1992 Wraight et al.
5,305,830 A * 4/1994 Wittrisch ..... E21B 23/14 166/250.01
5,426,368 A 6/1995 Benimeli et al.
5,468,153 A 11/1995 Brown et al.
5,735,351 A 4/1998 Helms
5,823,257 A 10/1998 Peyton
5,881,310 A * 3/1999 Airhart ..... E21B 47/124 710/3
6,138,756 A 10/2000 Dale
6,250,402 B1 * 6/2001 Brune ..... B82Y 25/00 175/45
6,341,654 B1 1/2002 Wilson et al.
6,396,276 B1 * 5/2002 Van Steenwyk ..... E21B 47/122 175/50
7,377,317 B2 5/2008 Radzinski et al.
8,044,819 B1 * 10/2011 Bessiere ..... E21B 47/06 340/853.3
8,474,548 B1 7/2013 Young et al.
8,863,861 B2 * 10/2014 Zientarski ..... G01V 11/002 166/66
9,512,716 B2 * 12/2016 Liu ..... H04W 52/367
9,638,028 B2 * 5/2017 Gao ..... E21B 47/121
9,759,830 B2 9/2017 Andrews et al.
9,765,613 B2 9/2017 Cramer et al.
10,119,393 B2 11/2018 Derkacz et al.
2001/0022239 A1 * 9/2001 Brune ..... B82Y 25/00 175/45
2002/0070030 A1 6/2002 Smith et al.
2002/0070033 A1 6/2002 Headworth
2002/0096364 A1 * 7/2002 Brune ..... B82Y 25/00 175/45
2003/0136583 A1 * 7/2003 Brune ..... B82Y 25/00 175/45
2004/0084218 A1 * 5/2004 Brune ..... B82Y 25/00 175/45
2005/0046588 A1 3/2005 Wisler et al.
2005/0052949 A1 * 3/2005 Gaston ..... E21B 47/02208 367/57
2005/0115708 A1 6/2005 Jabusch
2005/0150689 A1 7/2005 Jogi et al.
2006/0119364 A1 6/2006 Chen et al.
2006/0124355 A1 * 6/2006 Brune ..... B82Y 25/00 175/45
2007/0056722 A1 3/2007 Angman et al.
2007/0181304 A1 * 8/2007 Rankin ..... E21B 23/08 166/297
2007/0215343 A1 9/2007 McDonald et al.
2007/0247328 A1 * 10/2007 Petrovic ..... G01V 11/002 340/853.7
2008/0006400 A1 1/2008 Coyle
2008/0066905 A1 3/2008 Aivalis et al.
2008/0121431 A1 * 5/2008 Brune ..... B82Y 25/00 175/45
2008/0156477 A1 7/2008 Aivalis et al.
2008/0159077 A1 7/2008 Madhavan et al.
2008/0196904 A1 8/2008 Angman et al.
2008/0216554 A1 9/2008 McKee
2008/0230216 A1 9/2008 Angman
2008/0271924 A1 * 11/2008 Lurie ..... E21B 4/04 175/57
2009/0012711 A1 1/2009 Harmon
2009/0038850 A1 * 2/2009 Brune ..... E21B 47/02224 175/45
2009/0255730 A1 * 10/2009 Brune ..... B82Y 25/00 175/45
2009/0277631 A1 11/2009 Minto et al.
2009/0321174 A1 12/2009 Endo et al.
2010/0065329 A1 * 3/2010 Zientarski ..... E21B 47/12 175/24
2010/0206544 A1 8/2010 Dowling et al.
2010/0328096 A1 12/2010 Hache et al.
2011/0005767 A1 1/2011 Muff et al.
2011/0277990 A1 11/2011 Kotsonis et al.
2011/0280104 A1 11/2011 McClung
2011/0315445 A1 12/2011 Runia et al.
2012/0068528 A1 3/2012 Grief et al.
2012/0085582 A1 * 4/2012 Brune ..... B82Y 25/00 175/45
2012/0197528 A1 8/2012 Le et al.
2012/0230151 A1 9/2012 Almaguer
2013/0068528 A1 3/2013 Gray
2013/0118807 A1 * 5/2013 Yang ..... E21B 7/06 175/24
2014/0121974 A1 * 5/2014 Itskovich ..... G01V 3/38 702/7
2014/0131103 A1 * 5/2014 Brune ..... B82Y 25/00 175/45
2014/0190686 A1 7/2014 Cannan et al.
2014/0265565 A1 9/2014 Cooley et al.
2014/0308105 A1 10/2014 Soertveit et al.
2015/0012217 A1 1/2015 Legendre
2015/0070185 A1 3/2015 Schulz et al.
2015/0090459 A1 4/2015 Cain et al.
2015/0300161 A1 * 10/2015 Kamata ..... E21B 47/01 166/250.01
2015/0337650 A1 * 11/2015 Balogh ..... E21B 47/122 340/854.4
2016/0061027 A1 * 3/2016 Gao ..... E21B 47/121 702/7
2016/0138390 A1 * 5/2016 Arntsen ..... E21B 47/02208 175/45
2016/0291192 A1 * 10/2016 Cuevas ..... G01V 3/20
2016/0298441 A1 * 10/2016 Orban ..... E21B 33/072
2016/0298442 A1 * 10/2016 Orban ..... E21B 23/02
2016/0298449 A1 * 10/2016 Orban ..... E21B 47/12
2017/0097441 A1 * 4/2017 Eiskamp ..... E21B 7/04
2017/0111112 A1 * 4/2017 San Martin ..... E21B 47/00
2018/0045559 A1 * 2/2018 Hawthorn ..... G01H 9/004

FOREIGN PATENT DOCUMENTS

WO WO-2004086093 A1 * 10/2004 ..... E21B 47/02208
WO 2005064114 A1 7/2005
WO 2009085348 A2 7/2009
WO 2012058296 A2 5/2012

* cited by examiner

DOWNHOLE INSTRUMENT FOR DEEP FORMATION IMAGING DEPLOYED WITHIN A DRILL STRING

CROSS-REFERENCE TO RELATED APPLICATIONS

This application claims priority to U.S. Provisional Application having Ser. No. 62/146,731, which was filed on Apr. 13, 2015. This application also claims priority to U.S. Provisional Application having Ser. No. 62/147,246, which was filed on Apr. 14, 2015. Each of these priority provisional applications is incorporated by reference in its entirety.

BACKGROUND

During drilling operations, information is sometimes transmitted to the surface from instruments within the wellbore, and/or from the surface to downhole instruments. For example, signals may be transmitted to or from measuring-while-drilling (MWD) equipment, logging-while-drilling (LWD) equipment, steering equipment, or other equipment. Such information may assist operators in the task of efficiently drilling a wellbore by providing information related to tool-face orientation and formation composition, and allowing commands and configuring of the downhole instruments, among other possible uses.

In some situations, generally after drilling at least a portion of the wellbore, information about the subterranean formation may be acquired using sensors deployed into the wellbore for deep-imaging of the sub-terrain. For example, seismic data may be acquired using geophones, enabling the generation of vertical seismic profiles, and other types of seismic images, to be generated, which may provide insight into the structure, lithology, etc. of the formation. A seismic source, generally a vibrator, is then used to generate seismic waves that propagate though the formation and are detected by the seismic sensors such as geophones, accelerometers or geophones. For borehole seismic imaging, the seismic sensor may cover an adequate extent of the wellbore. In many such applications, the seismic sensors may be moved within the wellbore, while the surface seismic source may be stationary. This type of seismic technique is generally not done simultaneously with drilling operations, but may be done when the drill string is removed, using wireline logging methods associated with surface seismic source.

Another deep-imaging technique may be based on electromagnetic systems. In this technique, an electromagnetic signal is passed through the formation and detected by a receiver. The characteristics of the signal may provide information about the formation within about 50 feet (about 15 m) of the wellbore. Further, in a completed well, cross-well tomography can be performed by electromagnetic system. For electromagnetic tomography, the source and the receiver may be moved to multiple positions to for additional illumination paths. This type of electromagnetic tomography is generally not done simultaneously with drilling operations, but may be done when the drill string is removed, using wireline logging method in one well while the source may be located at the surface or in another well.

SUMMARY

Embodiments of the disclosure may provide a method for acquiring data in a wellbore. The method includes deploying an instrument connected to an instrument line into a drill string, through a sealed entry port formed in a drilling device coupled to the drill string, the drill string being at least partially within the wellbore, the wellbore penetrating a subterranean formation. The method also includes transmitting a signal from a source and through the formation. The signal is sensed by the instrument in the drill string. The method further includes determining one or more formation characteristics based on the signal sensed by the instrument, and performing one or more drilling processes using the drill string, while transmitting the signal, determining the one or more formation characteristics, or both.

Embodiments of the disclosure may also provide a system for acquiring data in a wellbore. The system includes a drilling device including an entry port. The system also includes a sealing device coupled to the drilling device and configured to seal the entry port, a drill string in communication with the entry port and at least partially positioned within a wellbore that penetrates a subterranean formation, and an instrument line received through the entry port and through an interior of at least a portion of the drill string. The sealing device is configured to seal with the instrument line, while allowing the instrument line to move with respect thereto. The system further includes an instrument coupled to the instrument line and positioned within the drill string, the instrument including at least one of a seismic sensor and a voltage sensor.

The foregoing summary is not intended to be exhaustive, but is provided merely to introduce a subset of the aspects of the present disclosure. These and other aspects are presented in greater detail below.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
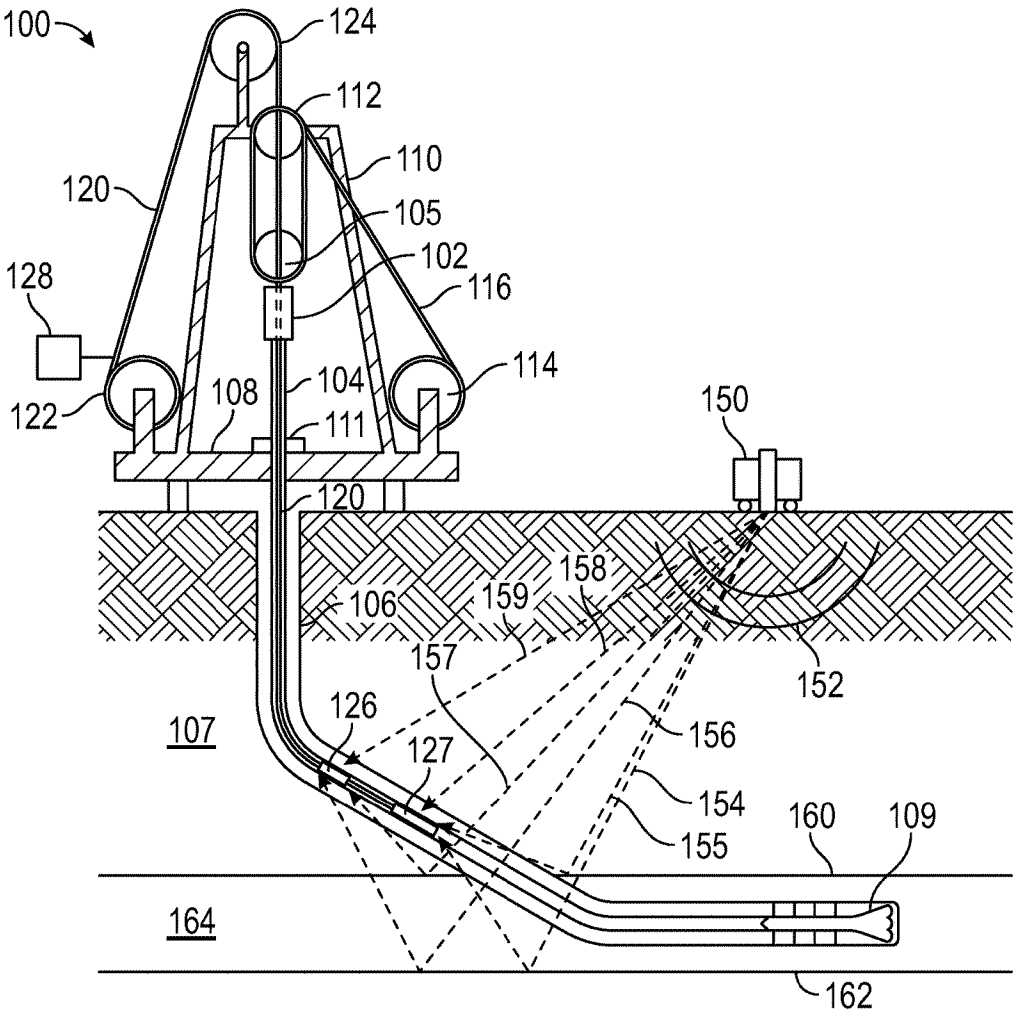
FIG. 1 illustrates a side, schematic view of a drill string logging tool deployed as part of a drilling rig, according to an embodiment.

FIG. 1 illustrates a schematic view of a drilling rig 100, according to an embodiment. The drilling rig 100 may provide a system by which data may be acquired within a wellbore 106, in addition to drilling the wellbore 106. For example, the drilling rig 100 includes a drilling apparatus 102 and a drill string 104 coupled thereto. The drilling apparatus 102 may include any type of drilling device, such as a top drive or any other device configured to support, lower, and rotate the drill string 104, which may be deployed into a wellbore 106 extending through a subterranean formation 107. In the illustrated embodiment, the drilling apparatus 102 may also include a travelling block 105, which may include one or more rotating sheaves. Further, the drill string 104 may include a bottom-hole assembly 109, which may include a drill bit, mud motor, LWD and/or MWD equipment, or other equipment.

The drilling rig 100 may also include a rig floor 108, from which a support structure (e.g., including a mast) 110 may extend. A slips assembly 111 may be disposed at the rig floor 108, and may be configured to engage the drill string 104 so as to enable a new stand of tubulars to be added to the drill string 104 via the drilling apparatus 102.

A crown block 112 may be coupled to the support structure 110. Further, a drawworks 114 may be coupled to the rig floor 108. A drill line 116 may extend between the drawworks 114 and the crown block 112, and may be received through the sheaves of the travelling block 105. Accordingly, the position of the drilling apparatus 102 may be changed (e.g., raised or lowered) by spooling or unspooling the drilling line 116 from the drawworks 114, e.g., by rotation of the drawworks 114. The drilling apparatus 102 may rotate the drill string 104 as part of the drilling operation, e.g., to rotate a drill bit of a bottom-hole assembly at the distal end of the drill string 104.

The drilling rig 100 may also include an instrument line 120, which may be received through the drilling apparatus 102 and into the drill string 104. The instrument line 120 may be spooled on an instrument line spool 122, and may be received at least partially around a line sheave 124 between the instrument line spool 122 and the drilling apparatus 102. In an embodiment, the instrument line spool 122 may be coupled to the rig floor 108 as shown, but in other embodiments, maybe positioned anywhere on the rig 100, e.g., at or below the crown block 112, or in proximity, but off of, the rig 100. The sheave 124 may be installed above the crown-block 112, below the crown-block 112, or on the side of the crown block 112. In some embodiments, the sheave 124 may be attached to the travelling block 105.

The instrument line 120 may be connected to one or more downhole instruments, such as one or more drill string logging tools (two shown: 126, 127), which may be deployed into the interior of the drill string 104, as will be described in greater detail below. In an embodiment, the position of the drill string logging tools 126, 127 may be changed (e.g., raised or lowered) by spooling or unspooling the instrument line 120 from the instrument line spool 122. In the illustrated embodiment, the drill string logging tools may be geophones, hydrophones, or other types of seismic sensors. Further, the instrument line 120 may provide for wired communication with a controller 128, e.g., without calling for wires to be formed as a part of the drill pipe making up the drill string 104.

A seismic source 150, such as a seismic vibrator, as shown, may be employed to generate seismic waves within the formation 107, as schematically illustrated by waves 152. The source 150 may transmit a frequency sweep of a signal into the formation 107. In another embodiment, the seismic source 150 may generate an impulse, using either explosive or air gun. The seismic source 150 may be positioned a horizontal distance from the wellbore 106, referred to as an offset. The waves 152 are depicted, for purposes of illustration herein, by rays 154, 155, 156, 157, 158, 159 (i.e., rays 154-159). It will be appreciated that potentially an infinite number of rays may be drawn, with those shown merely being employed for the purposes of illustrating aspects of the present disclosure.

As shown, the rays 154-159 may propagate through the formation 107 and at least some may be reflected by reflectors, generally at interfaces 160, 162 between two different types of rock, while some seismic energy propagates across the interface according to Snell's law defining diffraction. The interfaces 160, 162 may represent the boundaries for a reservoir 164 or another layer, compartment, or region of interest in the formation 107. In addition, reflection and refraction events may also exist in the overburden (i.e., the rock in the formation 107 above the reservoir 164). Information about such events in the overburden may also be collected.

The rays 154-159 (reflected or direct arrivals) of the seismic waves 152 may be sensed by the drill string logging tools 126, 127. In turn, the data acquired by the drill string logging tools 126, 127 may be transmitted to the controller 128 (or another processor) for processing. For example, the controller 128 may consider the depth of the tools 126, 127, that is, the distance from the top surface. The depth may be based on the length of the instrument line 120, which may be determined based on the rotation of the instrument line spool 122. The controller 128 may also consider the offset of the seismic source 150, and knowledge gained during drilling about the formation at or near the wellbore 106. One, some, or each of these factors, and/or others, may then be employed to invert the seismic data acquired by the tools 126, 127 into information about the characteristics of the formation 107.

For deep-imaging of the formation 107, the seismic source 150 may be moved on surface to change the offset. This may directly affect the paths of the seismic rays 154-159, allowing imaging of the formation 107 at different offsets and ray paths (inclination of the rays). Furthermore, the logging tools 126, 127 may be moved in the drill string 104 allowing different rays to be received, for wider coverage of the image. With these two movements (at the source 150 and the receivers 126, 127), greater (e.g., full) seismic coverage can be achieved across the formation 107.

For reception of the signal at the logging tools (such as 126, 127), the transmitted seismic signal form the source 150 may be configured to promote a high signal-to-nose ratio (SNR) at reception. In one embodiment, the surface source 150 can be fired when the drilling activity is suspended so that the seismic sensor in the logging tools are not affected by noise due to drilling, such as friction with the well bore, vibrations, shock with the well bore, and flow noise. In another embodiment, the source 150 may be operated while some drilling activities are occurring, and in such case, the vibrator may send long and complex sweep of seismic signals into the formation 107, so that the SNR at reception after cross-correlation with transmitted signal is sufficient for proper seismic imaging purpose. The transmitted signal from the vibrator 150 can extend over more than 30 seconds and even be up to several minutes (two or more). Also multiples transmission of signal can be performed with a total time for transmission being less than six minutes for one point of imaging process. For seismic data processing, the downhole data acquisition may be synchronized with the clock controlling the seismic source. In particular, the clock in the logging instruments 126, 127 may be synchronized with the clock of the surface controller 128. This may be achieved by sending a synchronization signal along the instrument line 120.

Figure 2:
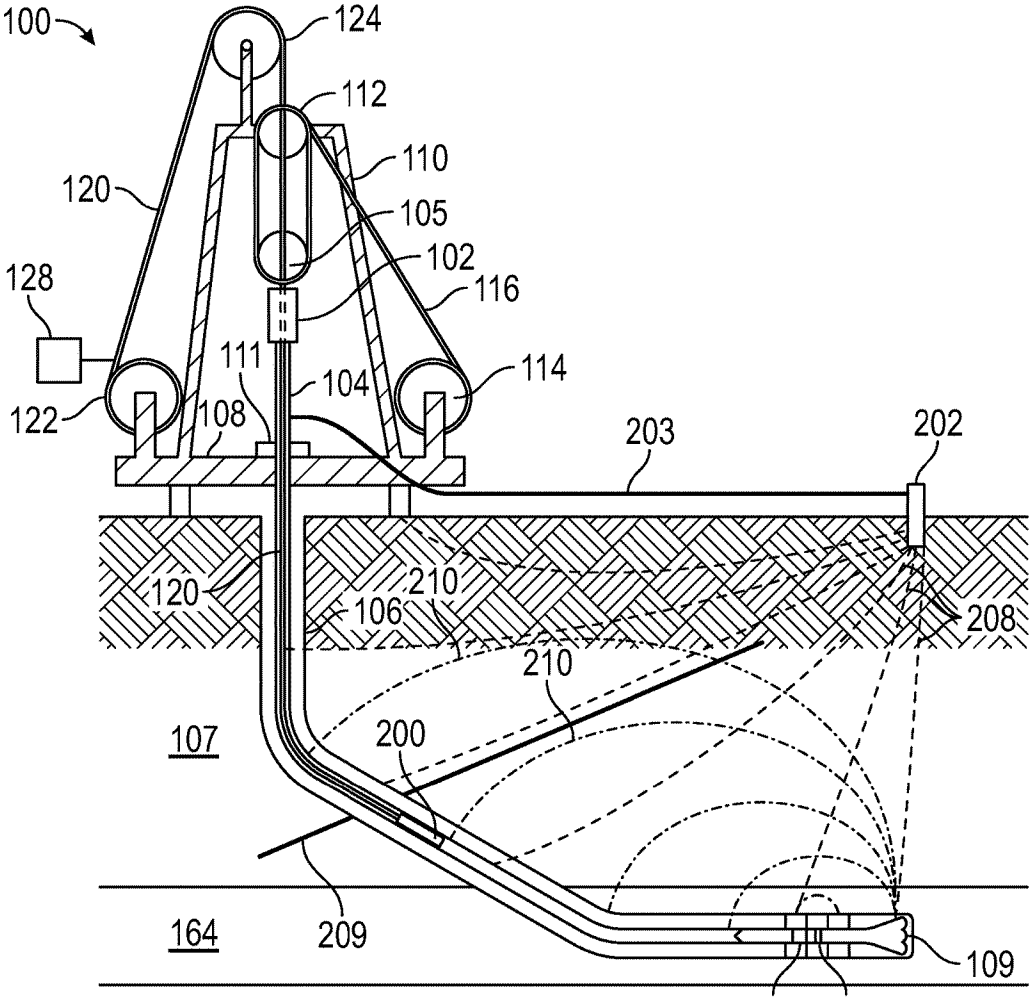
FIG. 2 illustrates a side, schematic view of another drill string logging tool, also deployed as part of a drilling rig, according to an embodiment.

FIG. 2 illustrates a side, schematic view of the drilling rig 100, showing another type of drill string logging tool 200 deployed in the drill string 104, according to an embodiment. The drill string logging tool 200 may configured to detect electrical current propagation in the formation 107. The current may be generated by either a surface source or a downhole source. For example, the source may be a dipole either installed at the surface or downhole. The source may include electrodes connected at the surface such as electrodes 202 or via the drill string 104. The drill string 104 may act as an electrode (as shown in FIG. 2) via grounding of the casing already in the well, as there is contact between the casing and drill sting 104.

A difference of potential may be generated between the two electrodes via the cable 203 or a current can be injected in cable 203 between the two electrodes. The downhole source may include the electrical gap 206 as used for e-mag MWD telemetry. This gap 206 may be an electrical insulator along the drill string 104. The current flowing in the formation 107 returns to the source via the metallic tubulars in the well such as the drill string 104 and/or the casing string.

The detection may be performed by spreading electrodes, allowing measurement of a voltage differential along the drill string 104 (or the casing, or another well tubular or structure). The detection may also be conducted using one or more antennas surrounding the metallic tubular (e.g., the drill string 104), or using magnetometers in the vicinity of the metallic structure (e.g., the drill string 104).

The surface electrode 202 may be offset from the wellbore 106 by a distance. The surface electrode 202 may be connected with a source of current, such as alternating current, e.g., via the cable 203. The current may travel from the surface electrode 202 and through the formation 107. Additionally, or instead of the surface electrode 202, the bottom-hole assembly 109 may include an electromagnetic ("e-mag") signal generator 204. The gap 206 may be employed with the signal generator 204. The surface dipole may be used either as transmitter or receiver. The downhole dipole (e.g., including the gap 206) may also be used as transmitter or receiver.

In this embodiment, two separate electrical circuits may be defined, both including the formation 107. In other embodiments, one of the two circuits may be present, and the other omitted. The first electrical circuit, represented by current lines 208 may be a "downlink," which may carry current from the surface electrode 202 to the drill string 104 via the formation 107. For example, at least some of the current injected via the surface electrode may follow a path 208 through the formation 107 to the bottom-hole assembly 109. This current may then pass through the bottom-hole assembly 109, through the drill string 104 (and/or the casing or another conductive structure), back to the top surface and through the current-injection line 203. Other portions of the current travel through the formation 107 to the drill string 104 via other paths 208.

During the traversal of the current through the drill string 104, the drill string logging tool 200 may measure the voltage differential along the drill string 104. From this measurement, the current density of the signal in the drill string 104 may be determined. For example, this measurement may be taken at multiple depths in the drill string 104. As the voltage differential changes according to depth, inferences about the existence of resistivity boundaries in the formation 107 may be made. For example, if a resistivity boundary 209 exists in the formation 107, the current density in the drill string 104 below a certain depth may be expected to be lower than the current density in the drill string 104 above the corresponding depth, as the current received in the drill string 104 travels upwards through the drill string 104. Accordingly, based on the voltage differential measured by the tool 200, tomographic information about the formation 107 between the drill string 104 and the surface electrode 202 may be inferred.

The second electrical circuit may extend from the e-mag signal generator 204, through the formation 107 via paths 210 to the bottom-hole assembly 109 on the other side of the gap 206, and back through the drill string 104 to the e-mag signal generator 204. Here again, the resistivity of the formation 107, which may vary, may affect the current density of the current within the drill string 104. In turn, the current density may be determined based on a voltage differential measured by the drill string logging tool 200. For example, if the resistivity boundary 209 exists at a particular depth, current in the drill string 104 above a corresponding depth may be expected to be attenuated, while current in the drill string 104 below the corresponding depth may be expected to be greater. The reverse situation may also be observed: if rock below the boundary has a higher resistivity than rock above the boundary, the paths 210 that are mostly above the resistivity boundary may be the preferential flowpaths, resulting in a higher current density in the drill string 104 above a corresponding depth.

For determining electromagnetic tomography, the receiver in the logging tool 200 may be moved in multiple positions along the drill string 104 via the instrument line 120 and the spool 122, while signals are transmitted from either the surface electrodes 202 or the downhole signal generator 206. Multiple surface electrodes 202 may be used to insure several injection points at surface, or a single electrode 202 may be moved. The downhole dipole 206 may be moved, as well, and this may occur during drilling and/or tripping operation. In some implementations, the surface signal generation via electrode 202 may be performed simultaneously with the downhole generation at the gap 206.

The receiver in the logging tool 200 may be able to simultaneously receive the two signals. The separation of the signals may be achieved by using different frequencies. Inversion processing may be performed based on the whole set of measurements involving multiple receiver positions and transmitter positions. The inversion processing allow to determine the positions of interface 209 even at fair extend form the well-bore: with even data input, multiple interfaces 209 can be determined and located.

Figure 3:
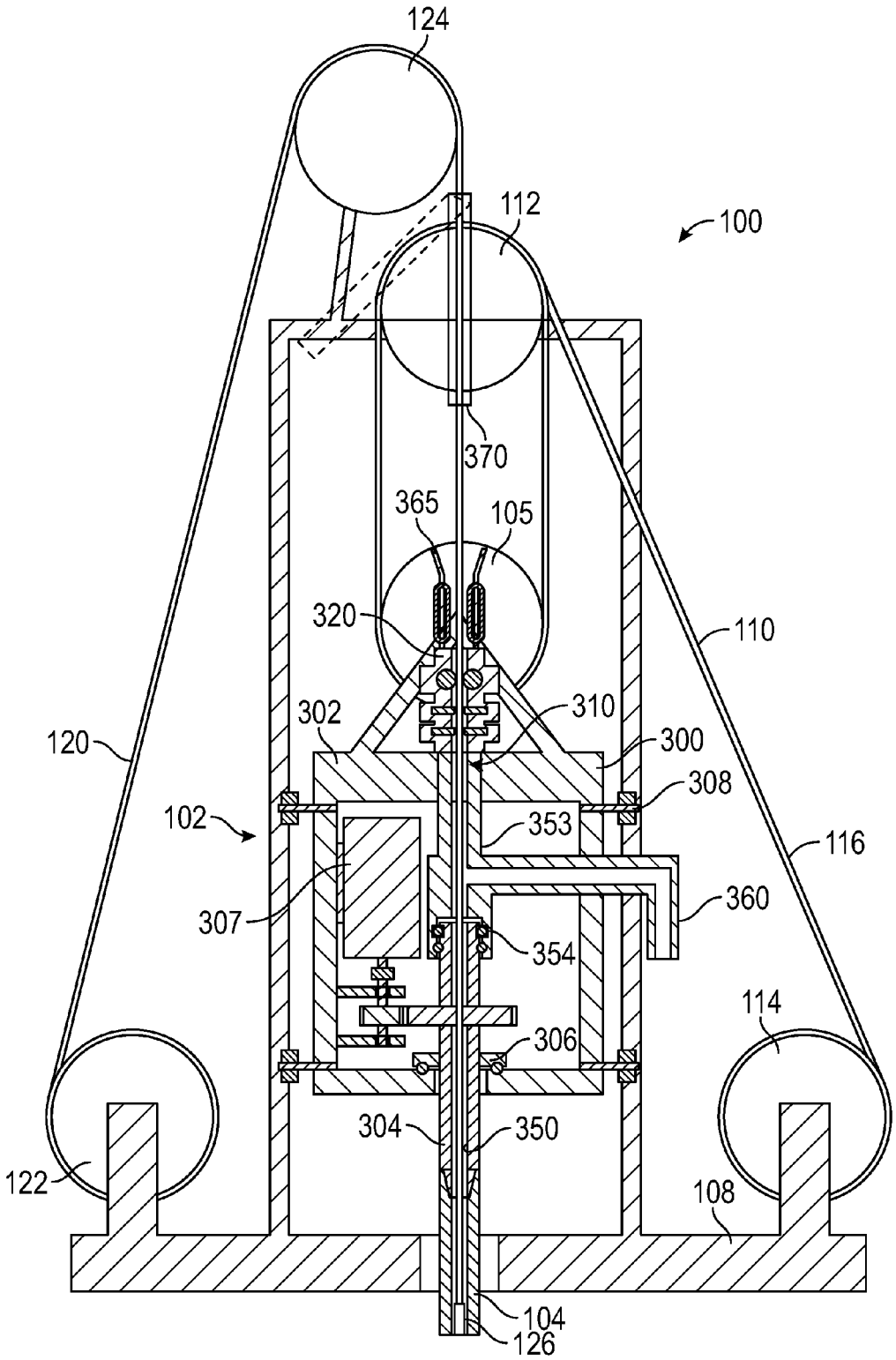
FIG. 3 illustrates a side, schematic view of a system for deploying the drill string logging tool within the drill string during drilling operations, according to an embodiment.

FIG. 3 illustrates an enlarged, partial, schematic view of the drilling rig 100, according to an embodiment. As shown, the drilling apparatus 102 may be suspended from the rig floor 108 via interaction with the travelling block 105, the crown block 112, and the drilling line 116 that is spooled on the drawworks 114. For purposes of illustration, the instrument 126 is shown suspended from the drilling rig 100 by the instrument line 120; however, it will be appreciated that any of the aforementioned instruments (e.g., drill string logging tools 126, 127, and/or 200), and/or others, may be employed.

In addition, the drilling apparatus 102 may include a drilling device 300, e.g., a top drive. The drilling device 300 may include a housing 302 and a shaft 304, which may be coupled to and extend out of the housing 302. In particular, the shaft 304 may be rotatably coupled to the housing 302 via a thrust bearing 306. The shaft 304 may be drive to rotate by a motor 307, which may be coupled to and/or disposed within the housing 302. Further, the shaft 304 may be connected to the drill string 104, such that rotation of the shaft 304 may cause the drill string 104 to rotate. By such connection between the shaft 304 and the drill string 104, at least a portion of the weight of the drill string 104 may be supported by the housing 302, which transmits the weight to the rig floor 108 via the crown block 112 and the support structure 110, as well as the drawworks 114. The drilling device 300 may also include one or more rollers 308 (four are shown), which may transmit reactionary torque loads to the support structure 110. The housing 302 may further include an entry port 310, through which the instrument line 120 may be received.

Further, the drilling apparatus 102 may include a sealing device 320, through which the instrument line 120 may be received into the entry port 310. The sealing device 320 may be coupled to the housing 302 of the drilling device 300, and may be movable therewith. Further, the sealing device 320 may have (e.g., be able to be operated in) at least two configurations. In a first configuration, the sealing device 320 may be configured to receive and seal with the instrument line 120. The instrument line 120 may be able to slide relative to the sealing device 320 when the sealing device 320 is in the first configuration, but fluid may be prevented from proceeding through the entry port 310 by the sealing device 320. In a second configuration, the sealing device 320 may completely seal the entry port 310, e.g., when the instrument line 120 is not received therethrough. Thus, the sealing device 320 may function similarly to a blowout preventer does for the drill string 104, serving to control access into the entry port 310.

The entry port 310 may communicate with an interior 350 of the shaft 304, e.g., via a conduit 353 within the housing 302. The shaft 304 may be rotatably coupled to the conduit 353 via swivel 354, as shown. Accordingly, the instrument line 120, when received through the entry port 310, may proceed through the conduit 353 and into the shaft 304, and then into the drill string 104.

The drilling device 300 may also receive a flow of drilling mud via a mud conduit 360. The mud conduit 360 may communicate with the conduit 353 within the housing 302, and thus the mud conduit 360 may be in fluid communication with the entry port 310, as well as the interior 350 of the shaft 304 and the drill string 104. The sealing device 320 may serve to prevent mud flow up through the entry port 310 in either or both of the first and second configurations thereof.

The drilling apparatus 102 may further include a line-pusher 365. The line-pusher 365 may be configured to apply a downwardly-directed force on the instrument line 120, which may cause the instrument line 120 to be directed downward, through the sealing device 320, the entry port 310, the conduit 353, the interior 352 of the shaft 304, and through at least a portion of the drill string 104, so as to deploy the instrument 126 (FIG. 1) therein. Further, the line-pusher 365 may be coupled to the housing 302 of the drilling device 300 and may be movable therewith. In an embodiment, the line-pusher 365 may be directly attached to the sealing device 320, e.g., such that the sealing device 320 is positioned between the housing 302 and the line-pusher 365. As such, the line-pusher 365 may be configured to push the instrument line 120 through the entry port 310 via the sealing device 320.

The line-pusher 365 may be employed to overcome initial fluid resistance provided by the drilling mud coursing through the mud conduit 360. Further, the line-pusher 365 may provide for rapid deployment of the instrument line 120 through the drill string 104, e.g., faster than the velocity of the drilling mud therein, and thus the line-pusher 365 may overcome drag forces of the instrument 126 and the drilling line 116 in contact with the mud.

The drilling apparatus 102 may also include a pivotable guide 370, through which the instrument line 120 may be received. The pivotable guide 370 may be positioned, as proceeding along the line 120, between the line sheave 124 and the line-pusher 365. The pivotable guide 370 may be movable across a range of positions, for example, between a first position, shown with solid lines, and a second position, shown with dashed lines. In the first position, the pivotable guide 370 may direct the instrument line 120 between the sheaves of the crown block 112 and between the sheaves of the travelling block 105 and toward the entry port 310. In the second position, the pivotable guide 370 may direct the instrument line 120 away from the entry port 310. For example, the second position may be employed when raising the drilling device 300 so as to accept a new stand of tubulars on the drill string 104 and/or when initially running the instrument 126 and the instrument line 120 into the entry port 310, as will be described in greater detail below.

Figure 4:
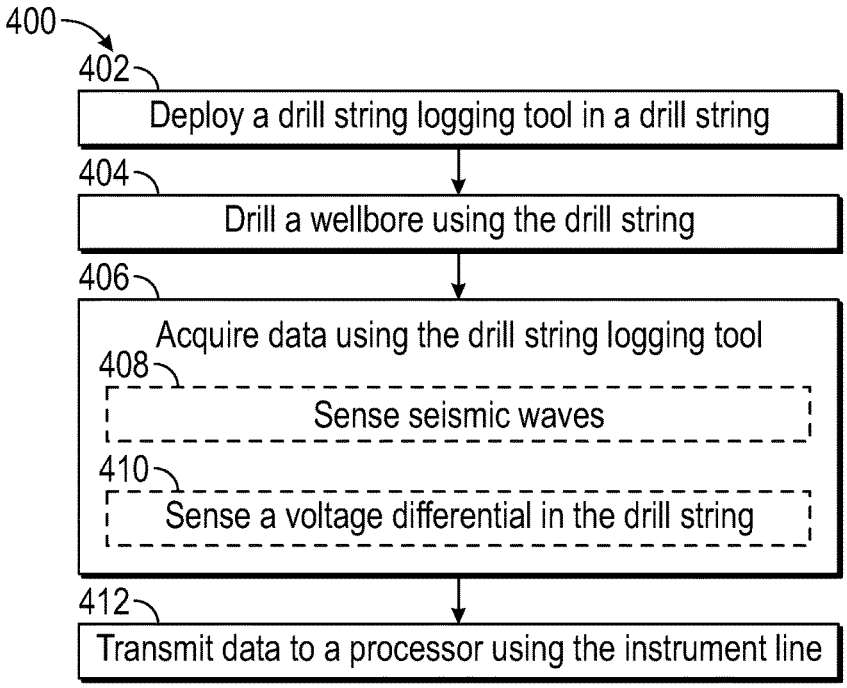
FIG. 4 illustrates a flowchart of a method for acquiring data within a drill string, according to an embodiment.

FIG. 4 illustrates a flowchart a method 400 for acquiring data within a drill string 104, according to an embodiment. Although the present method 400 is described with reference to the drilling rig 100 discussed above, it will be appreciated that this is merely an example, and embodiments of the method 400 may be applied using other structures.

The method 400 may begin by deploying an instrument (e.g., one or more of the drill string logging tools 126, 127 and/or 200) into the drill string 104, as at 402. As explained above, the instrument may be deployed via the entry port 310 in the drilling device 300 and the associated components described above. The sealing device 220 may be employed to selectively seal the entry port 310, e.g., when the instrument line 120 is received therethrough. Further, the drill string 104 may be coupled to the bottom-hole assembly 109 and may be rotated or otherwise operated by the drilling device 300. Accordingly, the method 400 may also include performing drilling operations (e.g., drilling the wellbore 106) using the drill string 104 and the bottom-hole assembly 109, as at 404, which may occur at the same time that the instrument is deployed within the drill string at 402.

The method 400 may then include acquiring data using the instrument located in the drill string 104, with the data being related to the formation 107 in which the wellbore 106 extends, as at 406. For example, as shown in and described above with reference to FIG. 1, such data acquisition may include sensing one or more seismic waves generated by a seismic source 150, as at 408. In such case, the instrument may be or include a geophone, or several geophones.

In another example, as shown in and described above with reference to FIG. 2, such data acquisition may include sensing a current or voltage differential in the drill string 104 using the instrument. In such an embodiment, the method 400 may include generating an electromagnetic signal that propagates in the formation 107 and measuring either current or voltage drop along the drill string 104 using the drill string logging tool. The electromagnetic signal may originate from the surface electrode 202 or the e-mag signal generator 204 located in the bottom-hole assembly 109 or elsewhere. Further, in this embodiment, the method 400 may include determining a location of a resistivity boundary 209 in the formation 107 based on the measured either current or voltage drop along the drill string 104. For example, such location may be determined by comparing the voltage drop across two different portions of the drill string 104 (e.g., a first portion and a second portion located at different, e.g., adjacent, depths along the drill string 104). A greater voltage drop in one portion relative to the other may indicate a greater current density, and thus reveal that the drill string 104 portion being measured is part of a preferential flowpath for current proceeding through the formation 107. A lower voltage drop may indicate a lower current density, and thus reveal that the drill string 104 section being measured is not part (e.g., below or above) the preferential flowpath for the current proceeding through the formation. From this determination, inferences about the existence and location of resistivity boundaries 209 may be made.

In a specific embodiment, forward modeling may be employed to determine interface locations and/or resistivities in the formation based on the current detected in the drill string 104. For example, a current density in the drill string may be measured, e.g., at several locations, using the instrument in the drill string 104. A processor may include modeling software, which may predict current propagation in the drill string 104 based on one or more predicted interface locations and resistivities of layers in the formation. Accordingly, the processor may determine a modeled current density at the several positions along the drill string. Thus, several different models, with several current profiles along the drill string may be determined, each corresponding to one or more different interface locations and/or resistivities. The method may then include determining a match between the modeled current density and measured current density, and then selecting one or more formation interface locations form the plurality of interface locations, and one or more resistivities form the plurality of resistivities, based on the determined match.

The method 400 may also include transmitting data from the drill string logging tool to the controller 128 at the surface, as at 412. Such transmission may be wired, e.g., through the instrument line 120. Further, the measurement with the logging tool 126,127 may be performed during any operations performed using the drill string 104 and the drilling rig 100. For example, such operations may include drilling, tripping, and/or reaming. This means that data acquisition may occur while the drill string 104 is rotating, moving axially in the wellbore, and/or when mud is flowing inside the drill string 104.

Figure 5:
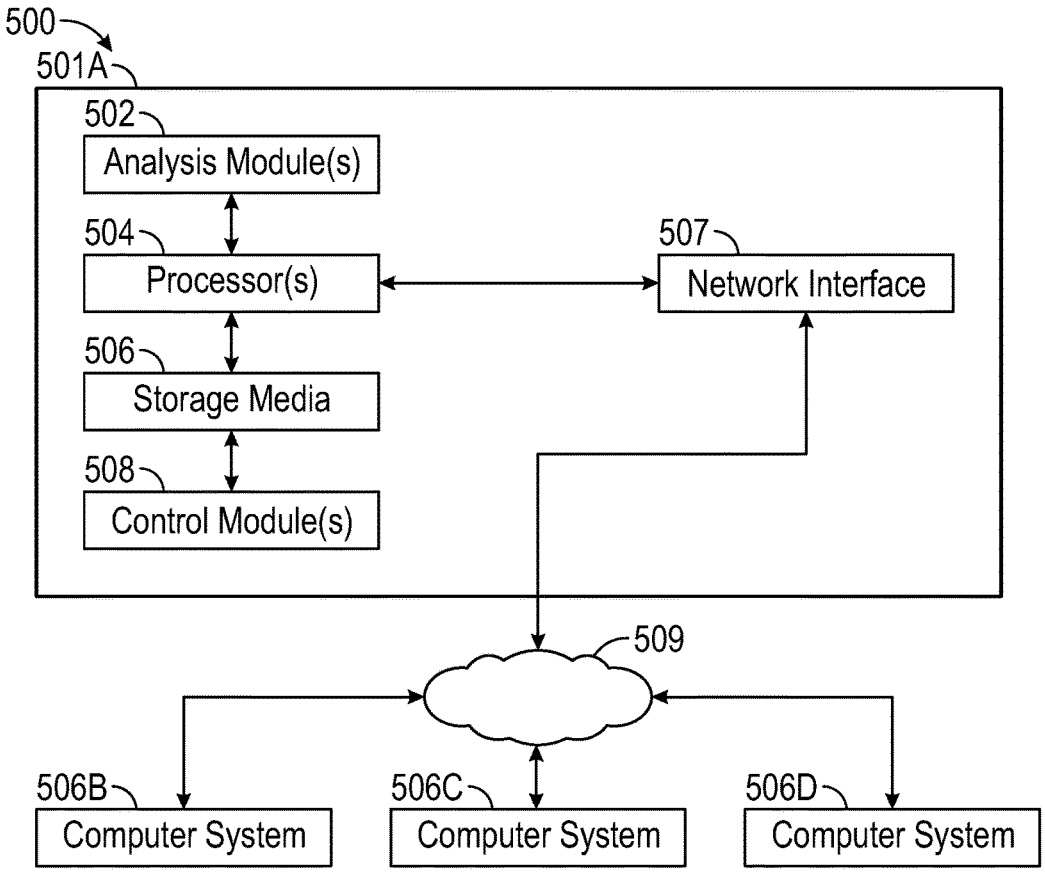
FIG. 5 illustrates a schematic view of a computing system, according to an embodiment.

In some embodiments, the methods of the present disclosure may be executed by a computing system. FIG. 5 illustrates an example of such a computing system 500, in accordance with some embodiments. The computing system 500 may include a computer or computer system 501A, which may be an individual computer system 501A or an arrangement of distributed computer systems. The computer system 501A includes one or more analysis modules 502 that are configured to perform various tasks according to some embodiments, such as one or more methods disclosed herein. To perform these various tasks, the analysis module 502 executes independently, or in coordination with, one or more processors 504, which is (or are) connected to one or more storage media 506. The processor(s) 504 is (or are) also connected to a network interface 507 to allow the computer system 501A to communicate over a data network 509 with one or more additional computer systems and/or computing systems, such as 501B, 501C, and/or 501D (note that computer systems 501B, 501C and/or 501D may or may not share the same architecture as computer system 501A, and may be located in different physical locations, e.g., computer systems 501A and 501B may be located in a processing facility, while in communication with one or more computer systems such as 501C and/or 501D that are located in one or more data centers, and/or located in varying countries on different continents).

A processor may include a microprocessor, microcontroller, processor module or subsystem, programmable integrated circuit, programmable gate array, or another control or computing device.

The storage media 506 may be implemented as one or more computer-readable or machine-readable storage media. Note that while in the example embodiment of FIG. 5 storage media 506 is depicted as within computer system 501A, in some embodiments, storage media 506 may be distributed within and/or across multiple internal and/or external enclosures of computing system 501A and/or additional computing systems. Storage media 506 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLU-RAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 500 contains one or more rig control module(s) 508. In the example of computing system 500, computer system 501A includes the rig control module 508. In some embodiments, a single rig control module may be used to perform some or all aspects of one or more embodiments of the methods disclosed herein. In alternate embodiments, a plurality of rig control modules may be used to perform some or all aspects of methods herein.

The computing system 500 is one example of a computing system; in other examples, the computing system 500 may have more or fewer components than shown, may combine additional components not depicted in the example embodiment of FIG. 5, and/or the computing system 500 may have a different configuration or arrangement of the components depicted in FIG. 5. The various components shown in FIG. 5 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A method for acquiring data in a wellbore, comprising:

deploying an instrument connected to an instrument line into a drill string, through a sealed entry port formed in a drilling device coupled to the drill string, the drill string being at least partially within the wellbore, the wellbore penetrating a subterranean formation;

transmitting a signal from a source and through the formation, wherein the source is coupled to the drill string and the source comprises an electrode comprising a dipole, wherein the signal is sensed by the instrument in the drill string and wherein transmitting the signal comprises injecting a current into the formation from the source, at least a portion of the current being measured by the instrument in the drill string;

determining one or more formation characteristics based on the signal sensed by the instrument; and performing one or more drilling processes using the drill string, wherein the one or more drilling processes is performed while transmitting the signal, or determining the one or more formation characteristics, or both, wherein determining the one or more formation characteristics comprises:

measuring a measured current density in the drill string, using the instrument in the drill string;

predicting current propagation in the drill string based on a plurality of interface locations and a plurality of resistivities of layers in the formation, to determine a modeled current density at the plurality of positions along the drill string;

determining a match between the modeled current density and measured current density;

selecting one or more formation interface locations form the plurality of interface locations, and one or more resistivities form the plurality of resistivities, based on the determined match.

2. The method of claim 1, wherein measuring the measured current density comprises measuring multiple current densities based on multiple locations of a source of the current, wherein the match is determined based on a plurality of modeled current densities and a plurality of measured current densities.

3. The method of claim 1, wherein measuring the measured current density comprises measuring multiple current densities based on multiple locations of the instrument in the drill string, wherein the match is determined based on a plurality of modeled current densities and a plurality of measured current densities.

* * * * *